US006409635B1

(12) United States Patent
Maresh et al.

(10) Patent No.: US 6,409,635 B1
(45) **Date of Patent: *Jun. 25, 2002**

(54) RECUMBENT EXERCISE APPARATUS WITH ELLIPTICAL MOTION

(76) Inventors: Joseph D. Maresh, 19919 White Cloud Cir., West Linn, OR (US) 97068; Kenneth W. Stearns, P.O. Box 55912, Houston, TX (US) 77255

( * ) Notice: Subject to any disclaimer, the term of this patent is extended or adjusted under 35 U.S.C. 154(b) by 0 days.

This patent is subject to a terminal disclaimer.

(21) Appl. No.: 09/374,783

(22) Filed: Aug. 16, 1999

Related U.S. Application Data

(63) Continuation of application No. 08/914,278, filed on Aug. 19, 1997, now Pat. No. 5,938,570, which is a continuation-in-part of application No. 08/497,377, filed on Jun. 30, 1995, now Pat. No. 5,707,321.

(51) Int. Cl.[7] ..... A63B 69/16; A63B 22/00

(52) U.S. Cl. ..... 482/57; 482/51

(58) Field of Search ..... 482/51, 52, 53, 482/57, 70

(56) References Cited

U.S. PATENT DOCUMENTS

| | | | | |
|---|---|---|---|---|
| 4,616,823 A | | 10/1986 | Yang | 482/57 |
| 5,445,583 A | | 8/1995 | Habing | 482/57 |
| 5,611,758 A | | 3/1997 | Rodgers, Jr. | 482/57 |
| 5,707,321 A | | 1/1998 | Maresh | 482/57 |
| 5,836,855 A | | 11/1998 | Eschenbach | 482/57 |
| 5,916,065 A | * | 6/1999 | McBride et al. | 482/57 |
| 5,938,570 A | * | 8/1999 | Maresh | 482/57 |

* cited by examiner

*Primary Examiner*—Stephen R. Crow

(57) ABSTRACT

A recumbent cycling apparatus includes a foot support which moves through a substantially elliptical path of motion relative to a frame. A seat is movably mounted on the frame to facilitate adjustment of the seat relative to the foot support.

16 Claims, 6 Drawing Sheets

RECUMBENT EXERCISE APPARATUS WITH ELLIPTICAL MOTION

CROSS REFERENCE TO RELATED APPLICATION

This application is a continuation of U.S. patent application Ser. No. 08/914,278, filed on Aug. 19, 1997 (now U.S. Pat. No. 5,938,570), which in turn,is a continuation-in-part of U.S. patent application Ser. No. 08/497,377, filed on Jun. 30, 1995, now U.S. Pat. No. 5,707,321.

FIELD OF THE INVENTION

The present invention relates to exercise methods and apparatus and more particularly, to a recumbent cycling machine which facilitates foot movement through an elliptical path.

BACKGROUND OF THE INVENTION

Cycling machines are known in the art. In general, a person sits on a seat and faces toward handle bars with legs extending downward. With the feet on respective pedals, the person is able to move his or her legs through a continuous motion. However, a shortcoming of this type of exercise is that the magnitude of force exerted is limited by the weight of the user.

Leg press machines are known in the art. In general, a person sits in a chair and faces toward one or more movable levers or platforms. With the back supported by the chair and the feet on the lever(s), the person is able to exert force through his or her legs in excess of his or her body weight. However, a shortcoming of this type of exercise is that the leg motion stops and reverses at maximum extension or compression.

Recumbent cycles are also known in the art, and they provide the necessary support to facilitate exertion force in excess of body weight. However, the rotational movement of the pedals severely limits the range of motion through which a leg press may be executed. Thus, a need remains for an exercise apparatus which comfortably facilitates exertion of force in excess of body weight and through a continuous path of motion having an extended pressing range.

SUMMARY OF THE INVENTION

In one respect, the present invention may be seen to provide a novel linkage assembly and corresponding exercise apparatus suitable for linking circular motion to relatively more complex, generally elliptical motion. In particular, an intermediate portion of a first link is rotatably connected to a crank; a first end of the first link is sized and configured to support a person's foot; and a second, opposite end of the first link is connected to a rocker link. As the flywheel rotates, the rocker link pivots in reciprocal fashion, and the foot support travels through a generally elliptical path.

In another respect, the present invention may be seen to provide a novel exercise apparatus which supports a user in a seated position and allows the user to pedal through a generally elliptical path of motion. The linkage assembly is sized and configured to provide a comfortable path of motion, and the seat is adjustable relative to the frame to facilitate proper positioning of the user relative to the linkage assembly.

In yet another respect, the present invention may be seen to provide a novel linkage assembly and corresponding exercise apparatus suitable for linking reciprocal motion to relatively more complex, generally elliptical motion. In particular, a handle member is rotatably connected to a free member and may be selectively linked to the rocker link. As the foot support moves through its generally elliptical path, the rocker member and the handle member pivot back and forth relative to the frame.

In still another respect, the present invention may be seen to provide a tri-modal arm exercise assembly. In particular, the handle member may be selectively linked to the frame, rather than the rocker link, in which case the handle member provides a stationary support. The handle member may also be selectively disengaged from both the frame and the rocker link, in which case the handle member pivots relative to both the rocker link and the frame. In other words, the handle member is operable in a stationary mode, a dependent mode, and an independent mode.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
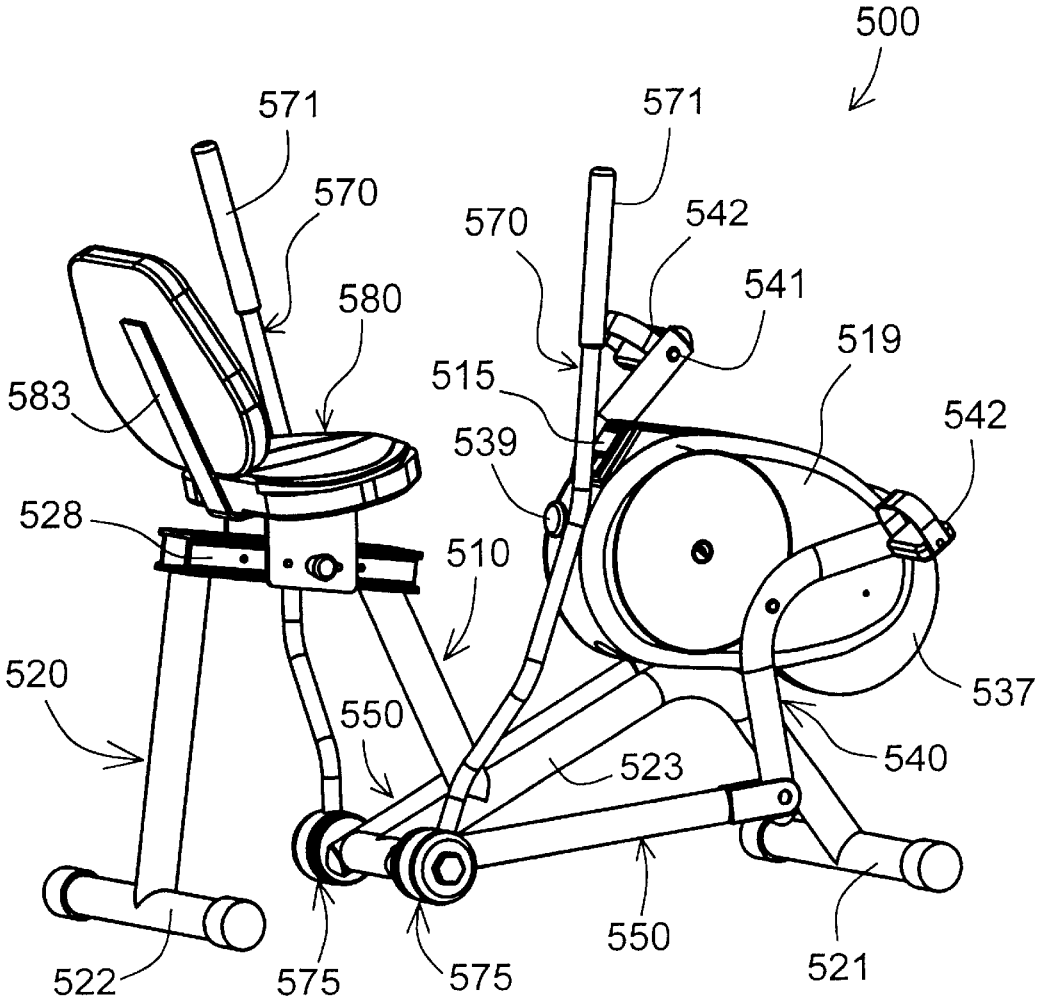
FIG. 1 is a perspective view of an exercise apparatus constructed according to the principles of the present invention.

An exercise apparatus constructed according to the principles of the present invention is designated as 500 in FIGS. 1–4. The apparatus 500 generally includes a frame; a leg exercise assembly movably mounted on the frame; an arm exercise assembly movably mounted on the frame; and a chair adjustably mounted on the frame. Generally speaking, the leg exercise assembly moves relative to the frame in a manner that links rotation of left and right cranks to generally elliptical motion of respective left and right foot supporting members. The term "elliptical motion" is intended in a broad sense to describe any closed curved path of motion having a relatively longer first or major axis and a relatively shorter second or minor axis.

The frame is designated as 510 and includes a base 520 which is designed to rest upon a generally horizontal floor surface 599. The apparatus 500 is generally symmetrical about a vertical plane extending lengthwise through the base 520, the only exception being the relative orientation of certain parts of the linkage assemblies on opposite sides of the plane of symmetry. Thus, like reference numerals are used to designate both the "right-hand" and "left-hand" parts on the apparatus 500, and when reference is made to parts on only one side of the apparatus 500, it is to be understood that similar parts are disposed on the opposite side of the apparatus 500. Those skilled in the art will also recognize that the portions of the frame 510 which are intersected by the plane of symmetry exist individually and thus, do not have any "opposite side" counterparts.

The base 520 includes a forward, transversely extending support 521; a rearward, transversely extending support 522;

and a rigid framework 523 interconnected therebetween. The rigid framework 523 may be described in terms of a generally L-shaped member and a generally U-shaped member. The forward support 521 is rigidly connected to the distal end of the shorter segment of the L-shaped frame member. The L-shaped frame member extends upward and rearward from the forward support 521 to its vertex, and then downward and rearward to the distal end of the longer segment. A housing or shroud 519 is mounted on the L-shaped frame member generally above the vertex. One end of the U-shaped frame member is rigidly connected to the longer segment of the L-shaped frame member intermediate the vertex and the distal end of the longer segment. An opposite end of the U-shaped frame member is rigidly connected to the rearward support 522.

Figure 2:
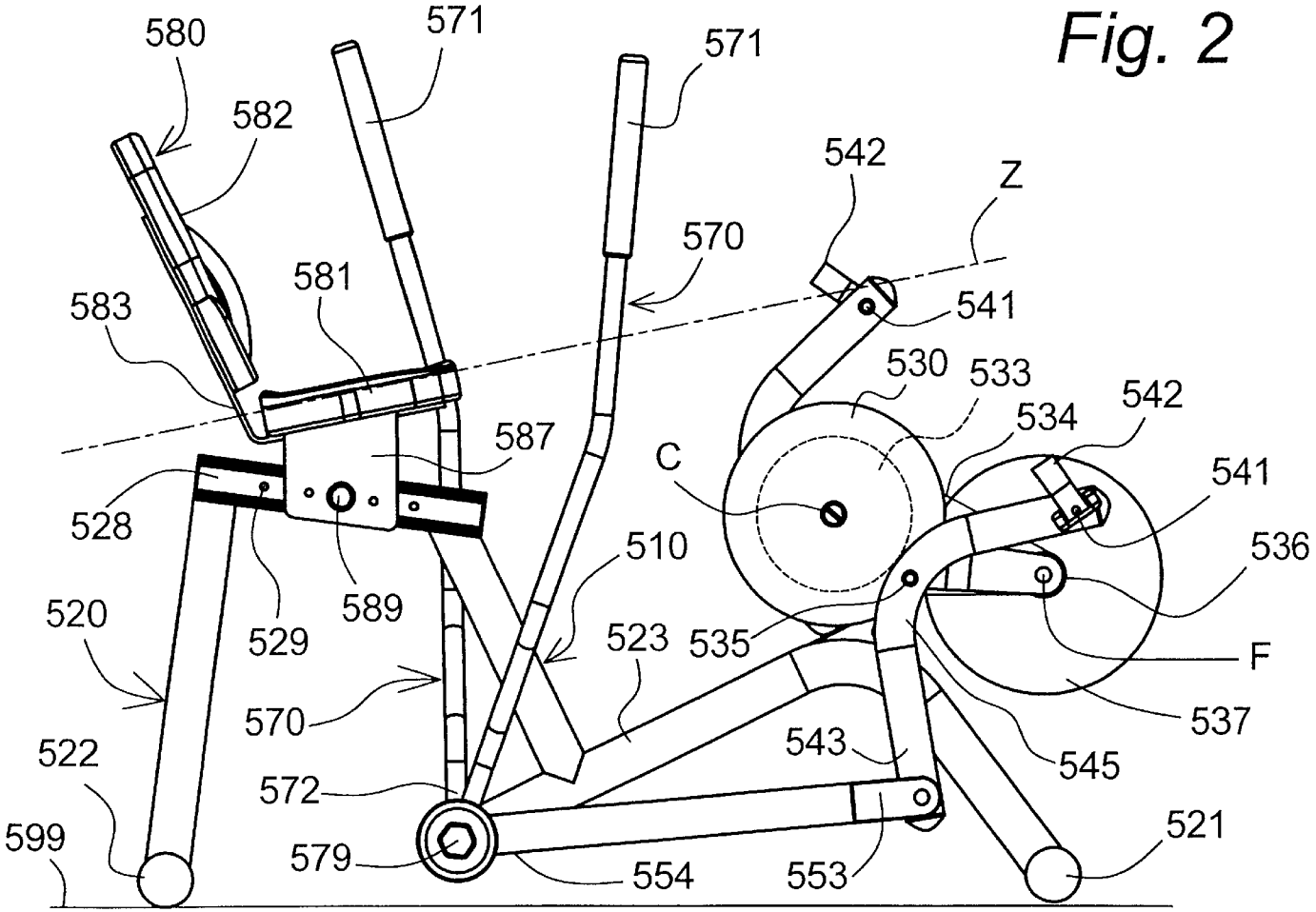
FIG. 2 is a side view of the exercise apparatus of FIG. 1, with a shroud removed.

As shown in FIG. 2, the cranks 530 are solid discs which are rotatably mounted to the framework 523 by means known in the art, and which rotate about a crank axis C. Those skilled in the art will recognize that crank arms or other rotating members may be substituted for the discs shown in FIG. 2. On each side of the apparatus 500, a radially displaced shaft 535 is rigidly secured to the crank 530 by means known in the art. For example, each shaft 535 may be inserted into a respective hole in the crank 530 and welded in place. Each shaft 535 is secured to the crank 530 at a point radially displaced from the axis C, and thus, each shaft 535 rotates at a fixed radius about the axis C.

As shown in FIG. 2, a flywheel 537 is rotatably mounted to the framework 523 by means known in the art and rotates about a flywheel axis F. The cranks 530 are connected to the flywheel 537 by means known in the art to provide a "stepped up" flywheel arrangement. In particular, a belt 534 is formed into a closed loop about a relatively large diameter pulley 533 secured to the crank shaft and a relative small diameter pulley 536 secured to the flywheel shaft. As a result of this arrangement, the members 530 and 537 rotate together, but the latter rotates faster than the former. Those skilled in the art will recognize that other known types of inertia altering mechanisms may be added to or substituted for the stepped up flywheel arrangement.

The housing or shroud 519 houses the cranks 530, the pulleys 533 and 536, and the belt 534, as well as a portion of the flywheel 537. The housing 519 supports a user interface panel 515 and a resistance adjustment knob 539, each of which is connected to the cranks 530 and/or the flywheel 537 in a manner known in the art. The interface panel 515 displays data such as elapsed time, speed of exercise, distance traveled, and allows the user to input information regarding such data. The knob 539 is rotated to increase or decrease drag on the flywheel 537, which may be imparted by a taut strap, for example.

First rigid connectors or links 540 are rotatably connected to respective cranks 530. In particular, each link 540 has an intermediate portion 545 which is rotatably mounted on a respective shaft 535. Each link 540 also has a first portion 541 which is connected to a pedal 542, and a second portion 543 which is rotatably connected to an end 553 of a second rigid connector or link 550. A line drawn through a respective pedal 542 and shaft 535 extends generally perpendicular to a line drawn through a respective end 553 and shaft 535. In other words, the links 540 may be described as generally L-shaped. A second, opposite end 554 of each second link 550 is rotatably mounted to the frame 510 at the distal end of the longer segment of the L-shaped frame member. In view of this arrangement, each second link or rocker link 550 pivots generally up and down relative to the frame 510.

Those skilled in the art will recognize that each of the components of the linkage assembly is necessarily long enough to facilitate the depicted interconnections but need not terminate immediately beyond the points of connection. Furthermore, for ease of reference in both this detailed description and the claims set forth below, the components are sometimes described with reference to "ends" being connected to other parts. For example, the link 550 may be said to have a first end 553 rotatably connected to the link 540 and a second end 554 rotatably connected to the frame 510. However, a term such as "rear end" should be interpreted broadly, in a manner that could include "rearward portion" and/or "behind an intermediate portion", for example. Those skilled in the art will further recognize that the above-described components of the linkage assembly may be arranged and/or interconnected in a variety of ways without departing from the scope of the present invention.

Figure 3:
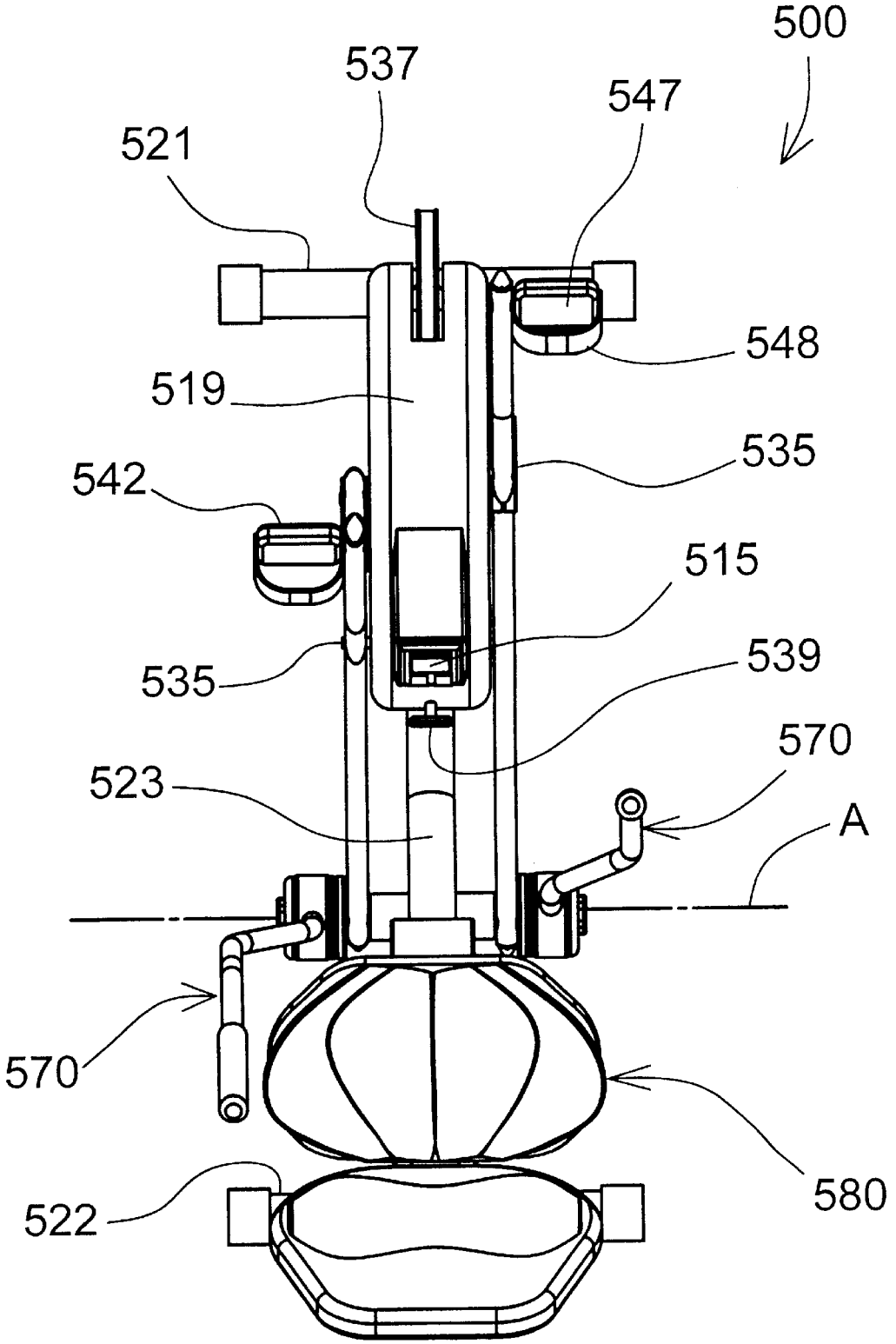
FIG. 3 is a top view of the exercise apparatus of FIG. 1.
Figure 4:
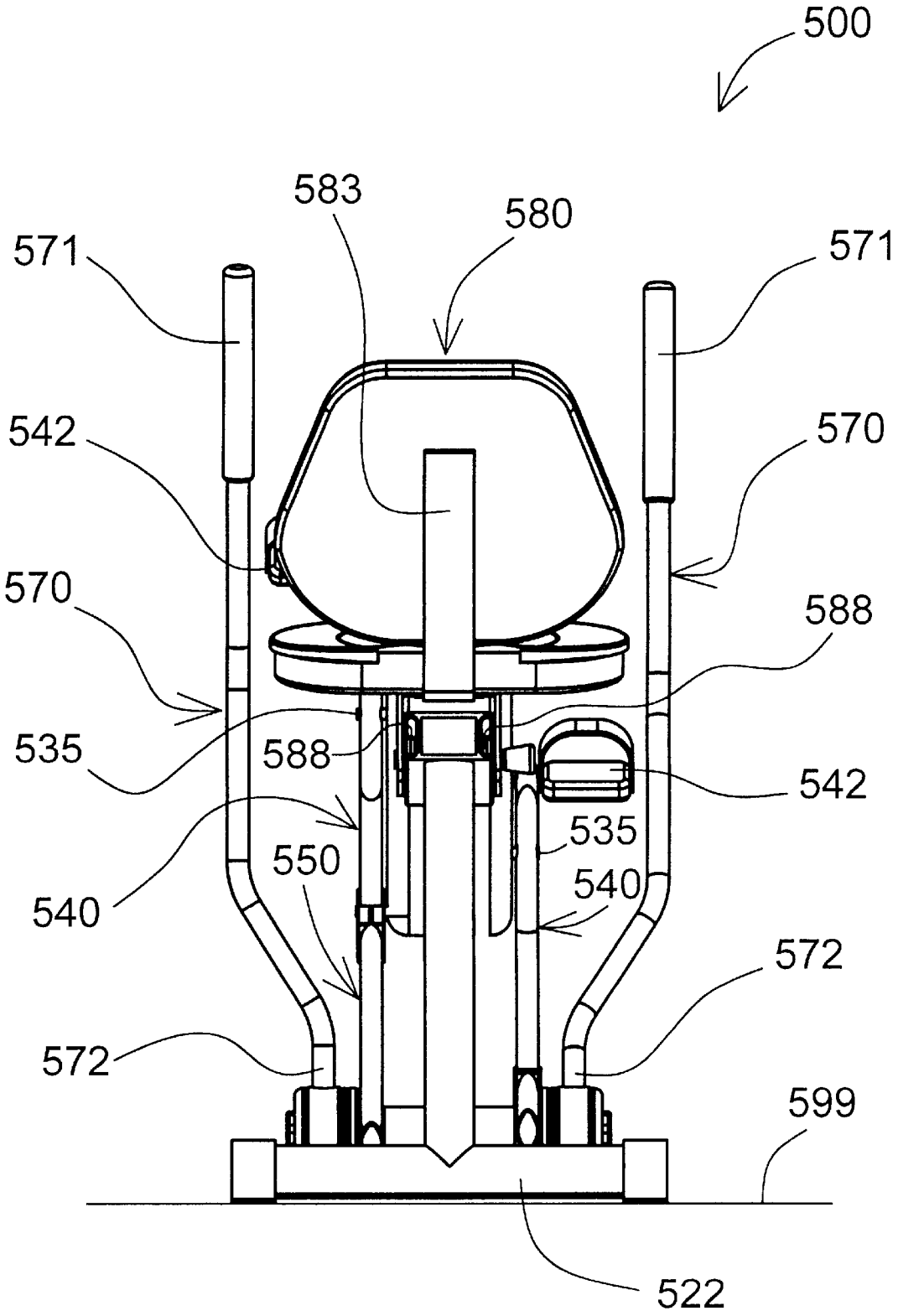
FIG. 4 is a rear view of the exercise apparatus of FIG. 1.

As shown in FIG. 3, each pedal 542 provides a bearing surface 547 against which a person's foot may push downward and/or forward, and a toe loop or cup 548 against which a person's foot may pull upward and/or backward. Movement of either pedal 542 causes rotation of the cranks 530 and reciprocal movement of the rockers 550. The arrangement of parts is such that the pedals 542 are constrained to travel through a substantially elliptical path. In other words, the links 540 and 550 may be described as a linking means, movably interconnected between the frame 510 and the cranks 530, for linking rotation of the cranks 530 to elliptical movement of the foot supports 542. As shown in FIG. 2, the rocker links 550 are movable to a substantially horizontal orientation.

An arm exercise member or pole 570 is rotatably mounted to each side of the frame 510 at the rearward, distal end of the L-shaped frame member. Each pole 570 has a first or upper end 571 which is sized and configured for grasping, and a second or lower end 572 which is connected to the frame 510. Each pole 570 pivots about an axis A (see FIG. 3) relative to the frame 510, as does each rocker link 550. A resistance mechanism 575 is interconnected between each pole 570 and the frame 510 in a manner which resists rotation of the pole 570 but does not interfere with pivoting of the rocker link 550. The magnitude of resistance may be adjusted by rotating a knob 579 relative to the frame 510. Alternatively, the poles 570 may be rigidly secured to the rocker links 550 and pivot together therewith.

The chair 580 is mounted on the base of the U-shaped frame portion. The chair 580 includes a generally horizontal support or seat 581, a generally vertical support or backrest 582, and a support structure 583 interconnected therebetween. The seat 581 defines a plane Z (see FIG. 2) through which the pedals 542 travel during exercise motion.

The base of the U-shaped frame portion defines a rail having channels 528 which open in opposite directions. A flange or bracket 587 extends downward from the seat portion of the chair 580 and adjacent opposite sides of the rail. Rollers or wheels 588 (see FIG. 4) are rotatably mounted on the bracket 587 and are disposed inside the channels 528 to rollably mount the chair 580 to the frame 510. A pin 589 is mounted on the bracket 587 and biased toward the rail. The pin 589 inserts into any of a plurality of holes 529 in the rail to releasably secure the chair 580 in place relative to the frame 510. In other words, the rollers 588 and the pin 589 cooperate with the rail to provide a means for adjusting the position of the chair 580 relative to the frame 510, including the arm axis A and the crank axis C.

To use the apparatus 500, a person sits in the chair 580 and extends his or her legs forward so that each foot engages a respective pedal 542. If the person needs to move the chair 580 toward or away from the pedals 542, he or she simply reaches down and pulls outward on the pin 589 and urges the chair 580 in the desired direction. Although the pin 589 is spring-loaded to engage a successive hole 529 in the rail, an alternative pin might require the user to insert the pin 589 into a desired hole 529 in the rail. With the chair 580 comfortably positioned, the user may begin exercising and make any necessary adjustments in resistance to leg exercise and/or arm exercise.

Figure 5:
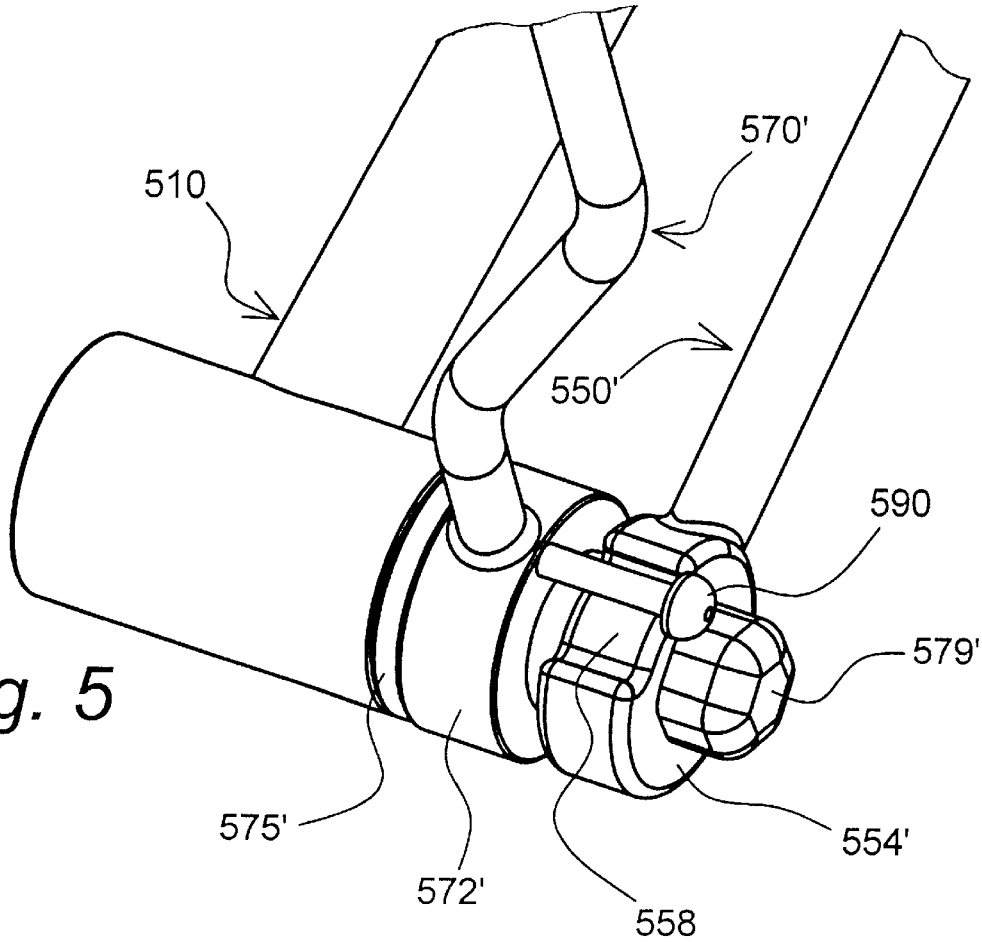
FIG. 5 is a perspective view of an arm exercise arrangement suitable for use on the exercise apparatus of FIG. 1.
Figure 6:
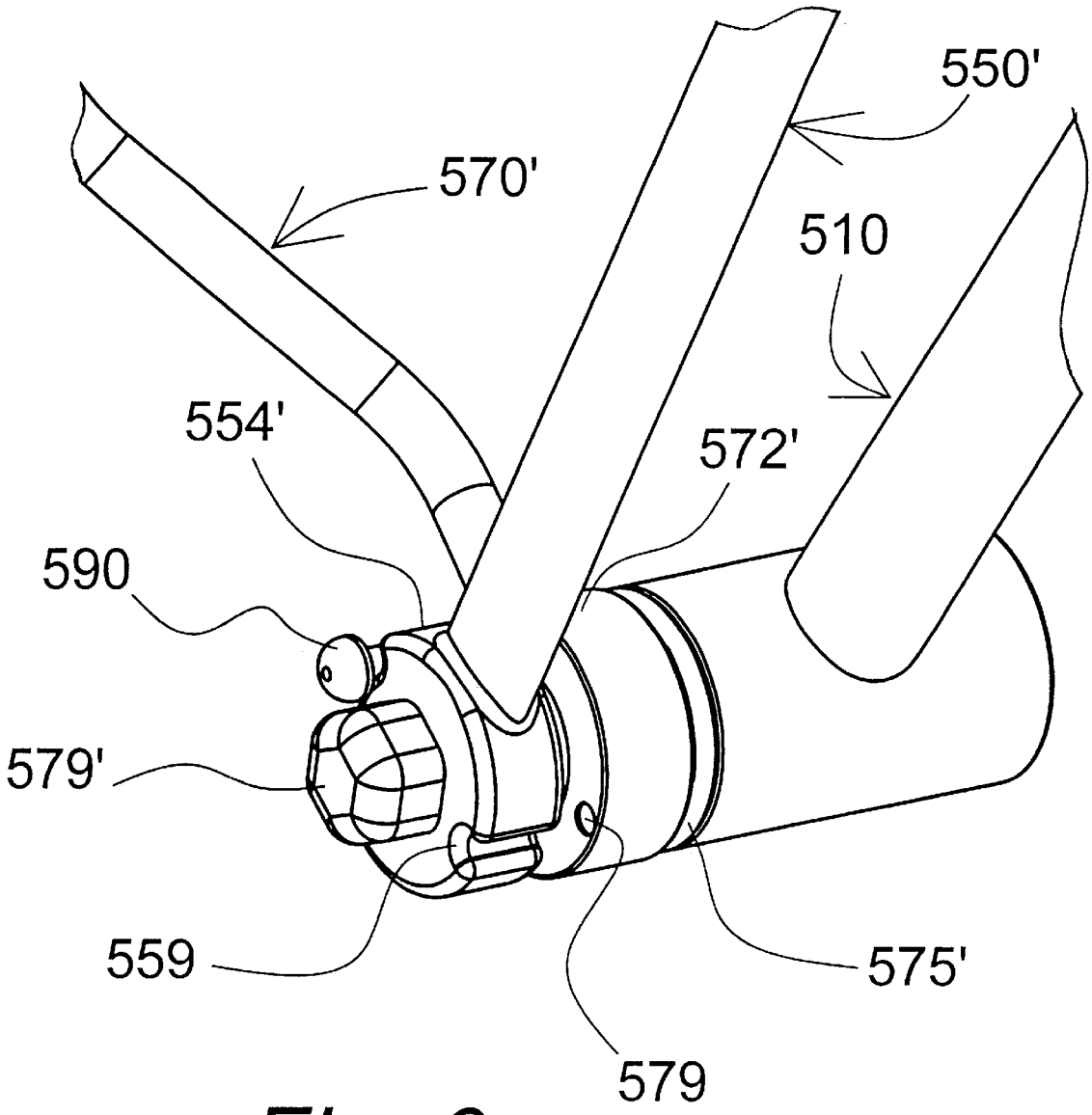
FIG. 6 is another perspective view of the arm exercise arrangement of FIG. 5.

An alternative embodiment arm exercise assembly is shown in FIGS. 5–6. As suggested by the common reference numerals, this alternative assembly is suitable for use on the preferred embodiment 500. A pole 570' has a lower end 572' which is rotatably connected to the frame 510. In this embodiment, a resistance mechanism 575', comprising at least one friction disc, is disposed between the frame 510 and the lower end 572' of the pole 570'. A rocker link 550' has a rearward end 554' which is coaxially aligned with the lower end 572' of the pole 570' and rotatably connected to the frame 510 outside of the pole 570'.

A knob 579' is rotatably connected to the frame 510 outside of the rocker link 550'. A thrust bearing is disposed between the knob 579' and the rocker end 554'and another thrust bearing is disposed between the rocker end 554' and the pole end 572'. As a result, the knob 579' may be rotated to increase frictional resistance between the pole end 572' and the resistance mechanism 575',but without affecting pivoting of the rocker link 550'. Those skilled in the art will recognize that other arrangements or resistance devices may be used without departing from the scope of the present invention.

A pin 590 may be inserted through a hole in the pole end 572' and an aligned hole in the frame 510 to lock the pole 570' against rotation relative to the frame 510. An arcuate cavity or depression 558 is formed in a sector about the rocker end 554' to provide clearance for rotation of the rocker 550' relative to the frame 510 and the pin 590. The pin 590 may alternatively be inserted through a groove 559 in the rocker end 554' and into another hole 579 in the pole end 572' to lock the pole 570' to the rocker end 554' so that they rotate together relative to the frame 510. If the pin 590 is removed entirely, the pole 570' is free to pivot relative to the frame 510 and the rocker 550'. In other words, the present invention provides a tri-modal arm exercise assembly. In a first mode, the pole 570' functions as a fixed arm support; in a second mode, the pole 57' functions as an arm exerciser which is linked to leg exercise movement; and in a third mode, the pole 570' functions as an independently movable arm exerciser. Those skilled in the art will recognize that this feature of the present invention may be applied to different types of exercise apparatus.

Although the present invention has been described with reference to specific embodiments and particular applications, those skilled in the art will recognize additional embodiments, modifications, and/or applications which fall within the scope of the present invention. For example, the spatial relationships, including the radius and/or angular displacement of the crank axes, may vary for different sizes, configurations, and/or arrangements of the components of the linkage assembly. In conclusion, the scope of the present invention is to be limited only to the extent of the claims which follow.

What is claimed is:

1. A recumbent exercise apparatus, comprising:

a frame designed to remain in a stationary position on a floor surface;

a seat mounted on the frame;

a left crank and a right crank, wherein each said crank is rotatably mounted on the frame and rotatable about a common crank axis disposed forward of the seat;

a left connector link and a right connector link, each said connector link having a first portion, a second portion, and a third portion, wherein the first portion of each said connector link is rotatably connected to a respective crank;

a left foot support and a right foot support, wherein each said foot support is connected to the second portion of a respective connector link;

a left rocker link and a right rocker link, wherein each said rocker link is pivotally interconnected between the frame and the third portion of a respective connector link; and a left handle and a right handle, wherein each said handle is pivotally mounted on the frame and selectively linked to a respective rocker link, wherein a first fastener is selectively inserted through aligned openings in the left handle and the left rocker link, and a second fastener is selectively inserted through aligned openings in the right handle and the right rocker link.

2. The apparatus of claim 1 wherein the first fastener is alternatively selectively inserted through aligned openings in the left handle and the frame, and the second fastener is alternatively selectively inserted through aligned openings in the right handle and the frame, whereby each said handle is locked against pivoting relative to the frame.

3. The apparatus of claim 2, wherein the first fastener is alternatively selectively removed from at least two of the left handle, the left rocker link, and the frame, and the second fastener is alternatively selectively removed from at least two of the right handle, the right rocker link, and the frame, whereby each said handle is pivotal relative to both the frame and a respective rocker link.

4. The apparatus of claim 1, wherein the first fastener is alternatively selectively removed from at least two of the left handle, the left rocker link, and the frame, and the second fastener is alternatively selectively removed from at least two of the right handle, the right rocker link, and the frame, whereby each said handle is pivotal relative to both the frame and a respective rocker link.

5. The apparatus of claim 1, wherein the handles and the rocker links pivot about a common pivot axis.

6. A recumbent exercise apparatus, comprising:

a frame designed to remain in a stationary position on a floor surface;

a seat mounted on the frame;

a left crank and a right crank, wherein each said crank is rotatably mounted on the frame and rotatable about a common crank axis disposed forward of the seat;

a left connector link and a right connector link, each said connector link having a first portion, a second portion, and a third portion, wherein the first portion of each said connector link is rotatably connected to a respective crank;

a left foot support and a right foot support, wherein each said foot support is connected to the second portion of a respective connector link;

a left rocker link and a right rocker link, wherein each said rocker link is pivotally interconnected between the frame and the third portion of a respective connector link; and a left handle and a right handle, wherein each said handle is pivotally mounted on the frame and selectively linked to a respective rocker link, wherein each said rocker link and each said handle pivot about a common pivot axis relative to the frame.

7. The apparatus of claim 6, wherein each said handle is disposed between the frame and a respective rocker link.

8. The apparatus of claim 7, wherein a respective friction disc is disposed between each said handle and the frame.

9. The apparatus of claim 8, wherein each said rocker link is sandwiched between two thrust bearings.

10. The apparatus of claim 9, wherein a respective adjustment knob is disposed outside each said rocker link and is threaded into engagement with the frame.

11. A recumbent exercise apparatus, comprising:

a frame designed to remain in a stationary position on a floor surface;

a seat mounted on the frame;

left and right cranks rotatably mounted on the frame;

left and right crank driven foot supports operatively connected to respective cranks;

left and right crank driven rocker links operatively connected to respective cranks; and left and right handles pivotally mounted on opposite sides of the frame and selectively linked to respective rocker links, wherein respective removable fasteners extend through aligned holes in the handles and the rocker links to selectively link the handles and the rocker links.

12. The apparatus of claim 11, wherein the handles and the rocker links pivot about a common pivot axis.

13. A recumbent exercise apparatus, comprising:

a frame designed to remain in a stationary position on a floor surface;

a seat mounted on the frame;

left and right cranks rotatably mounted on the frame;

left and right crank driven foot supports operatively connected to respective cranks;

left and right crank driven rocker links operatively connected to respective cranks; and left and right handles pivotally mounted on opposite sides of the frame and selectively linked to respective rocker links, wherein the handles and the rocker links pivot about a common pivot axis.

14. The apparatus of claim 13, further comprising thrust bearings disposed between respective handles and respective rocker links.

15. The apparatus of claim 14, further comprising friction discs disposed between respective handles and the frame.

16. The apparatus of claim 15, further comprising a means for adjusting compressive force acting on the friction discs.

* * * * *